United States Patent [19]

Gerling

[11] 4,176,268

[45] Nov. 27, 1979

[54] SYSTEM FOR HEATING USING A MICROWAVE OVEN ASSEMBLY AND METHOD

[75] Inventor: John E. Gerling, Cupertino, Calif.

[73] Assignee: Gerling Moore, Inc., Santa Clara, Calif.

[21] Appl. No.: 886,885

[22] Filed: Mar. 15, 1978

[51] Int. Cl.[2] ..... H05B 9/06

[52] U.S. Cl. ..... 219/10.55 A; 219/10.55 D; 219/10.55 M; 219/10.69

[58] Field of Search ..... 219/10.55 A, 10.55 D, 219/10.55 R, 10.55 M, 10.69; 99/443 R, 451; 426/243

[56] References Cited

U.S. PATENT DOCUMENTS

| | | | |
|---|---|---|---|
| 3,239,643 | 3/1966 | Kluck | 219/10.55 D |
| 3,699,899 | 10/1972 | Schiffmann et al. | 219/10.55 A X |
| 3,718,082 | 2/1973 | Lipoma | 219/10.55 A X |
| 3,780,251 | 12/1973 | Kee | 219/10.55 A |
| 3,961,568 | 6/1976 | Jeppson | 219/10.55 A X |
| 3,961,569 | 6/1976 | Kenyon et al. | 219/10.55 A X |

*Primary Examiner*—Arthur T. Grimley
*Attorney, Agent, or Firm*—Flehr, Hohbach, Test, Albritton & Herbert

[57] ABSTRACT

A system for heating objects by means of microwave energy in an assembly line fashion is disclosed herein and utilizes a specific microwave oven assembly especially suitable for this purpose. The oven assembly is designed to receive within its heating cavity a continuously or intermittent changing section of a conveyance mechanism, even though the cavity may be effectively sealed off from the ambient surroundings during its heating operation. In this manner, objects, even relatively large objects, can be conveyed into the cavity of the oven assembly where they are heated, then automatically conveyed out from the cavity in an assembly line fashion.

23 Claims, 4 Drawing Figures

SYSTEM FOR HEATING USING A MICROWAVE OVEN ASSEMBLY AND METHOD

BACKGROUND OF THE INVENTION

The present invention relates generally to heating using microwave energy and more particularly to a system and method of microwave heating objects, for example, fast food products, in an automated, assembly line fashion, and to a specifically designed microwave oven assembly especially suitable for this use.

One problem which continues to plague any typical "fast food" restaurant is the inability to keep up with the rush hour crowds, specifically those which appear at lunch or dinner time. One way to handle this is to precook the food, for example, hamburgers, ahead of time. Another way, however, and from a standpoint of quality a preferred way, is to develop a faster way to cook the sandwiches and particularly a way which could be automated, actually fashioned after an assembly line, and yet a way which is uncomplicated and economical.

One solution of course is to use a microwave oven. However, conventional microwave ovens do not lend themselves to automation, especially as part of an overall assembly line. Quite to the contrary, a typical microwave oven requires the operator first to open the door of the oven, then insert the object, for example a tray of hamburgers, then close the door, and so on. Certainly, it can be seen that this approach can be cumbersome and time consuming and even unreliable.

Another solution is what is commonly referred to as a microwave tunnel, such as is shown in U.S. Pat. Nos. 3,983,356 issued Sept. 28, 1976 and 3,754,111 issued Aug. 21, 1973, and sometimes referred to an end load, which does in fact lend itself quite readily to a continuous conveyor type of assembly line operation. The objects to be heated can be placed on a conveyor and taken into the heating section of the tunnel through one open end and moved out of this section through an opposite open end. However, one problem with this type of system for use in the type of operation discussed above, that is, for use in the fast food industry, is that the tunnel openings would have to be too large for efficient operation, at least from an economical standpoint. Too much microwave energy would be lost through these openings in a microwave tunnel sufficiently large to handle relatively large articles such as trays of sandwiches and in any event most likely would be much too expensive and complicated in design. There are also cases where one or two of the transverse dimensions of the product to be microwave-treated is larger than the electrically largest possible transverse dimension of the continuously open end loads. This transverse dimension has a fixed limit when larger than this, uncontrolled microwave leakage will result.

As will be seen hereinafter, the present invention provides for a microwave oven assembly which is not complicated in design and which is not too costly to manufacture and yet one which is especially suitable for assembly line use and, at the same time, one which is energy efficient.

OBJECTS AND SUMMARY OF THE INVENTION

It is a general object of the present invention to provide a novel system for heating using a microwave oven assembly and method which will overcome the foregoing limitations.

A further object is to provide a system of the above character which provides an openable door to access the oven which is compatible with automatic operation and which cooperates to permit movement of a continuous conveying belt through said oven when the door is open or shut and whether the belt motion is continuous, intermittent, or even oscillatory.

A further object is to provide a system of the above character which provides a door access microwave system which can be of arbitrary size up to the entire dimensions limit of the associated oven wall and which further is not limited by wavelength consideration as is access tunnel designs previously referred to in said U.S. Pat. Nos. 3,983,356 and 3,754,111.

Another object of the present invention is to provide an uncomplicated and economical system for and method of heating objects by means of microwave energy in an assembly line fashion.

Another object of the present invention is to heat even relatively large objects, for example trays of sandwiches, in an assembly line fashion and yet in a heat efficient way.

Still another object of the present invention is to provide a system which is capable of moving the articles, for example the trays of sandwiches, as they are being heated whereby to more uniformly heat them.

A further object of the present invention is to provide an economical and uncomplicated microwave oven assembly which is especially designed for use in the system or method just recited and yet an oven assembly which is energy efficient and reliable in use.

The particular microwave oven assembly disclosed includes a number of conventional components or parts. In fact, most of its components are conventional. For example, the assembly includes a housing which defines an internal heating cavity or chamber and which is constructed of conventional materials to effectively isolate the heating cavity. It also includes conventional means for producing microwave energy within the cavity for heating the objects therein and associated controls including for example an appropriate control for turning the oven assembly on and off and an appropriate control for changing the level of energy generated within the heating cavity.

In addition to the foregoing, this microwave oven assembly includes one and preferably two unconventional openings extending through its housing and into its feeding cavity. In addition, in accordance with the present invention, the assembly includes a door arrangement associated with each opening and connected with the housing. This door arrangement includes a predetermined door section which is movable between a first position and a second position. In its first position, the door section is spaced a sufficient distance from its associated opening to allow the articles to be heated to pass readily therethrough and into the heating cavity. In its second position, the door section closes this opening into the chamber but nevertheless allows for a subopening or gap sufficiently large to allow a conveyance mechanism for carrying objects into the chamber to extend into and through the chamber, even though the door section or sections are in their closed positions. Each door arrangement also includes means for moving its associated movable section between its open and closed positions, and seal means for reducing the amount of microwave energy escaping from within the heating cavity along the periphery of the movable section and through the subopening or gap to a level below a predetermined standard, when the movable section is in its closed position.

As will be seen hereinafter, in a preferred embodiment of the present invention, each door arrangement includes a first L-shaped door section fixedly connected to the housing of the oven assembly and having a vertical subsection positioned around the housing opening and a horizontal subsection extending from the bottom edge of the vertical subsection away from the opening. The door arrangement in this preferred embodiment also includes a second L-shaped door section which, however, is connected to the housing for movement between a first position a sufficient distance from the opening to allow articles to pass readily therethrough and a second position for closing the opening to the passage of articles. This movable door section also includes a vertical subsection and a horizontal subsection. The vertical subsection includes a surface which is located in confronting relationship with a surface on the vertical subsection of the fixed door section and also extends across the opening in the assembly housing, when the movable section is in its closed position. The horizontal subsection of the movable door section has a surface which is located in confronting relationship with a surface on the horizontal subsection of the fixed door section, also when the movable section is in its closed position. Moreover, the latter two subsections, that is, the horizontal subsections, together define a gap which is located therebetween and which extends into the housing opening when the movable door section is in its closed position. This gap, as stated previously, is sufficiently large to allow an object carrying conveyance mechanism to extend into the heating cavity through the gap.

It should be readily apparent that the microwave oven assembly just described is especially suitable for use with the conveyer or other such mechanism typically used in an assembly line type of operation. A continuously changing section of the conveyer can at all times be located within the heating cavity of the assembly through the gaps or subopenings described above, even though the cavity is otherwise closed. In this manner, the articles to be heated can be readily passed into and out of the heating cavity.

DETAILED DESCRIPTION AND PREFERRED EMBODIMENTS

Figure 1:
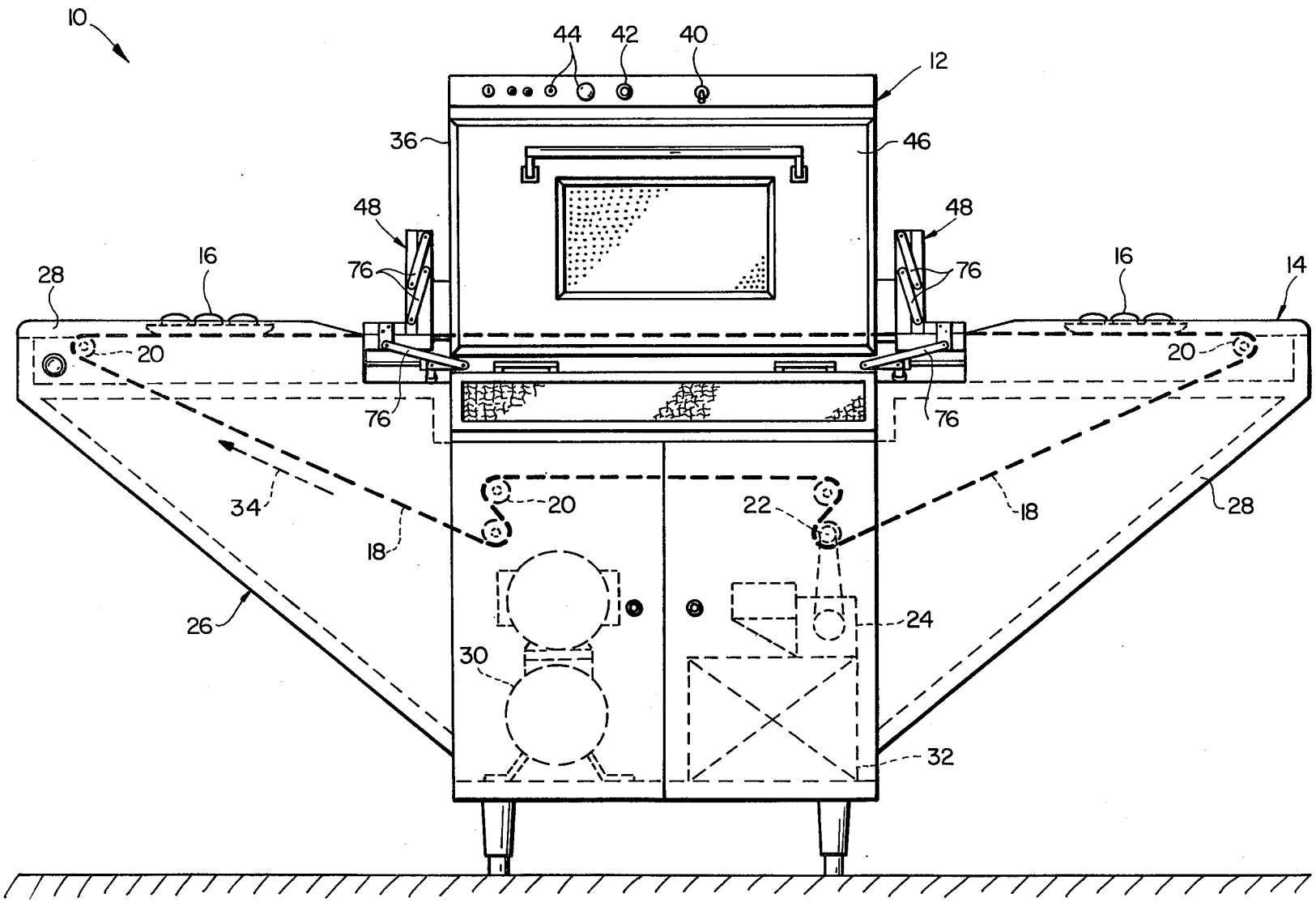
FIG. 1 is a front elevational view of a system for heating objects by means of microwave energy in an assembly line fashion and particularly illustrating a microwave oven assembly constructed in accordance with the present invention.

Turning now to the drawings, wherein like components are designated by like reference numerals throughout the various figures, attention is directed to FIG. 1 which illustrates a system 10 for heating objects by means of microwave energy in an assembly line fashion. This assembly includes the microwave oven assembly 12 constructed in accordance with the present invention and an overall conveyance arrangement 14. As will be seen hereinafter, microwave oven assembly 12, in its preferred embodiment, includes two doored entries into its heating cavity and conveyance arrangement 14, in its preferred embodiment, includes a conveyer belt. As will also be seen, this conveyer belt extends into the oven assembly through an appropriately defined gap extending along an edge of one of the oven doors and which passes out of the oven assembly through another gap extending along an edge of the other door. In this manner, an object to be heated, generally designated at 16, can be supported on the conveyer belt for automated movement into the oven assembly through one door and out of the assembly through the other door.

Having described system 10 generally, attention is now directed specifically to conveyance arrangement 14. As stated, this arrangement includes a continuous conveyer belt which is generally designated at 18. The conveyer belt, because it goes through the heating cavity of the microwave oven assembly, and because of its location within the gaps leading into and out of the oven assembly, should be constructed of a material which is compatible with the oven and with the ability to minimize energy loss through the gaps. One such material is silicon impregnated glass woven fiber. The belt is preferably as thin as possible, for example ten to fifteen mils thick, and is seamed together at its otherwise free ends, preferably in an end to end, single thickness manner, so as to minimize thickness and hence reduce the necessary width of gaps into the microwave oven assembly, as will be seen hereinafter. However, for all practical purposes, the otherwise free ends of the conveyer belt are more often seamed together and overlapped in a double thickness manner and, hence, the gaps in the oven assembly will have to compensate for this added thickness.

Figure 2:
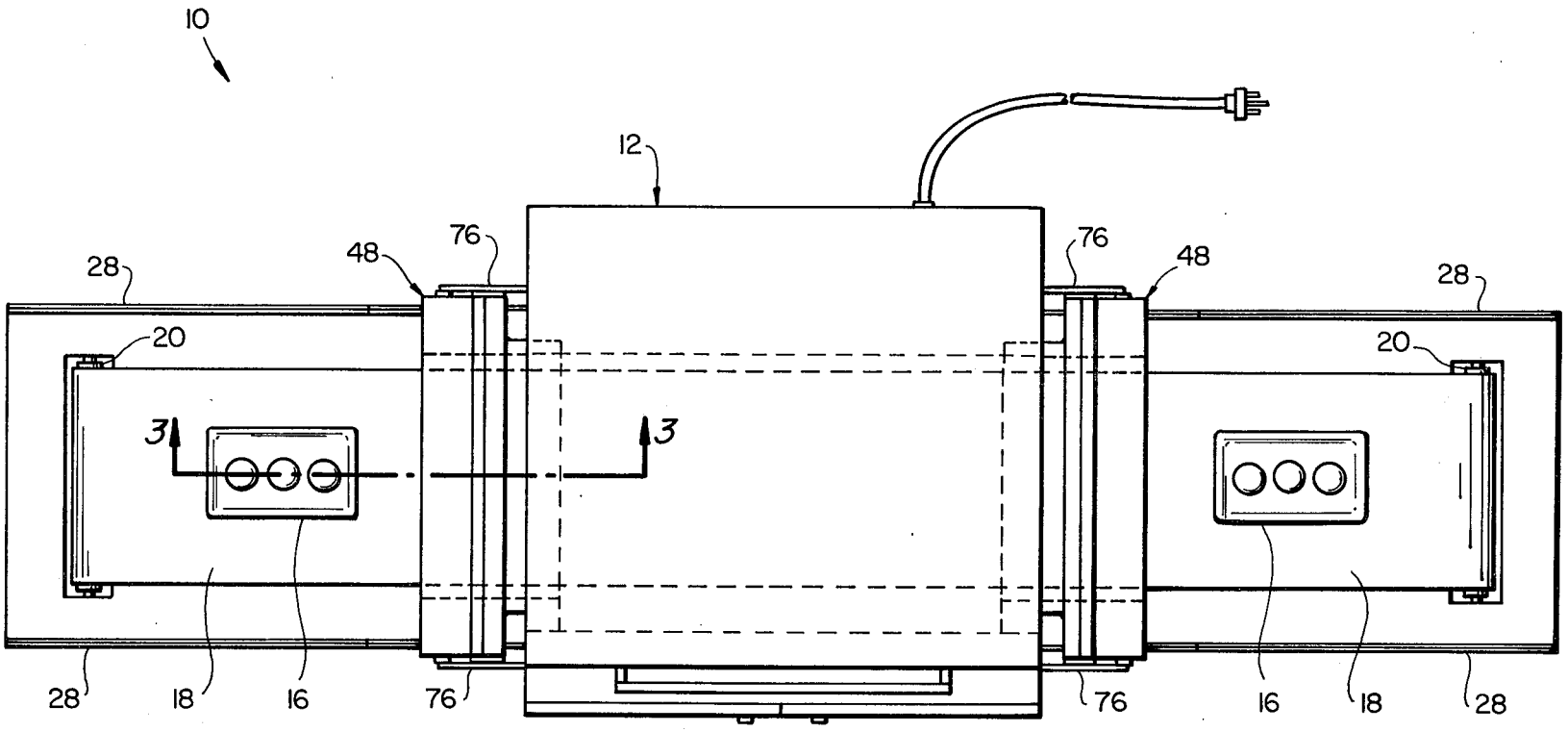
FIG. 2 is a top plan view of the system illustrated in FIG. 1.

As illustrated in FIG. 1, conveyer belt 18 extends around a number of drive pulleys 20 and a clutch pulley 22 comprising part of an overall clutch assembly 24. The drive pulleys are mounted to an overall frame assembly 26 and support a section of the conveyer belt for movement along a horizontal path, specifically the path passing through oven assembly 12. As illustrated best in FIG. 2, in conjunction with FIG. 1, frame assembly 26 includes a pair of laterally spaced skirts 28 located on each side of the oven assembly and extending up beyond opposite edges of the horizontally extending section of conveyer belt 18.

Conveyance arrangement 14 also includes a drive motor 30 and a suitable control network generally designated at 32 including the previously recited clutch assembly 24 for driving conveyer belt 18 in the direction of arrow 32 and/or the opposite direction, either manually or automatically, at preset intervals. In fact, this control network preferably includes means for driving the belt in synchronism with the operation of microwave oven assembly 12, in the manner to be described. Moreover, it preferably includes means for oscillating the conveyer belt so that an article 16, for example a tray of sandwiches, can be oscillated back and forth when in the oven assembly so as to be more uniformly heated. It is to be understood that this control network and, in fact, the entire conveyance arrangement, in and by itself, may be conventional and readily provided by those with ordinary skill in the art. This includes not only the overall control network, but also motor 30, the conveyer belt, and also the overall frame assembly for supporting the belt. Accordingly, a more detailed description of this overall arrangement is not deemed to be necessary.

Having described overall conveyance arrangement 14, attention is now directed to a detailed description of microwave oven assembly 12. As illustrated in FIG. 1, this assembly includes an overall housing 36 which defines an internal heating chamber or cavity 38 best seen in FIG. 3. This assembly also includes means (not shown) located within the housing for producing microwave energy within chamber or cavity 38 for heating articles 16 and a network of controls which may include, for example, an on/off switch 40, an indicator light 42 as well as other controls indicated generally at 44. These other controls may include means for controlling the amount of microwave energy generated within cavity 38 to control the temperature therein and will also include suitable controls for coordinating the operation of assembly 12 with operation of conveyance arrangement 14 in a manner to be described hereinafter.

The housing 36 and means for producing microwave energy as well as the network of controls for controlling operation of the oven assembly are themselves conventional components, as stated previously. Moreover, the controls which are required to coordinate operation of the microwave oven assembly and conveyance mechanism may also be conventional and readily provided by those with ordinary skill in the art. Moreover, this assembly may also include a hinge mounted door 46 for manual entry into heating cavity 38. Because the various components just recited including door 46 are conventional or may be readily provided, a further description of each is not deemed necessary.

Figure 3:
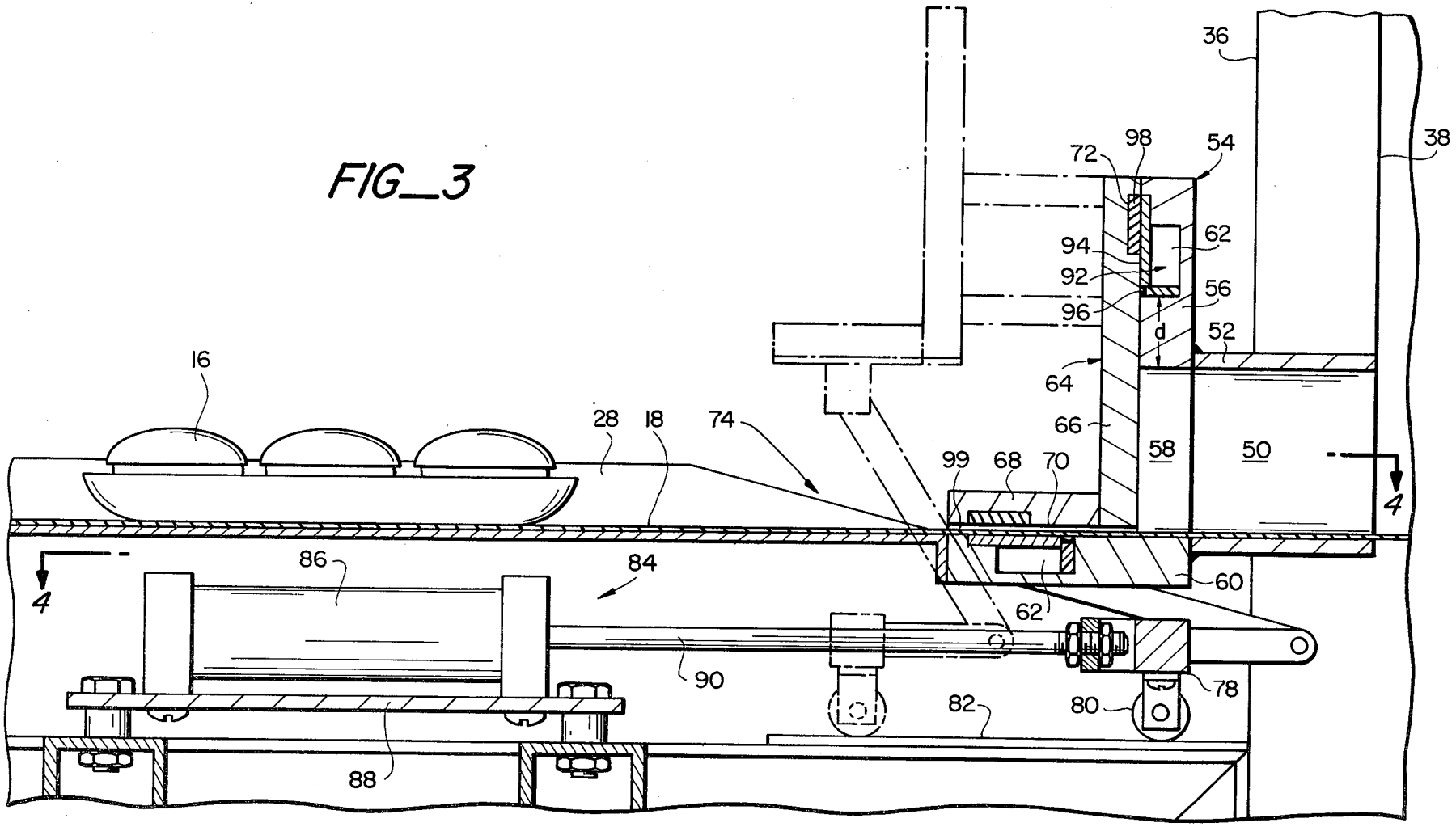
FIG. 3 is a sectional view of a part of the system of FIG. 1, taken generally along line 3—3 in FIG. 2.

In addition to the various equipment just recited, microwave oven arrangement 12 includes two substantially identical door arrangements 48, each of which is associated with an opening 50, one of which is illustrated in FIG. 3. As seen in this figure, opening 50 extends into cavity 38 through housing 36 and is defined by a horizontal extension sleeve 52 which projects through the housing and beyond the outer surface thereof. Each of these sleeves is provided for supporting, at least in part, an associated door arrangement 48.

Turning specifically to FIG. 3, attention is now directed to one of the door arrangements 48, specifically the left hand door arrangement as viewed in FIG. 1. This arrangement includes a first L-shaped door section 54 (actually its mirror image) which is welded or otherwise fixedly connected to the projecting end of support sleeve 52 and hence fixedly connected with housing 36. This door section includes the vertically extending subsection 56 which is positioned around opening 50, actually it includes its own opening 58 located in axial allignment with opening 50. Section 54 also includes the horizontal subsection 60 extending from the bottom edge of vertical subsection 56 and away from opening 50. In a preferred embodiment, this fixed door section is constructed of a single sheet of suitable material, specifically aluminum in the preferred embodiment, and pressed or otherwise formed into the L-shape illustrated. The opening 58 would most likely be initially cut out of the sheet.

As indicated in FIG. 3, fixed door section 54 also includes a groove or cavity which is generally indicated at 62. While not shown, this cavity extends along the combined outer periphery of the combined joining surfaces of subsections 56 and 60 in a continuous manner. In fact, in the preferred embodiment, this continuous cavity is formed into the door section before the latter is bent into its L-shape and hence, at that point, takes the form of a closed loop extending around the outer periphery of the sheet just inwardly of its edge. The specific function of this cavity as well as its specific location relative to openings 50 and 58 and its relative dimensions, will be discussed in detail hereinafter. For the moment, it should suffice to state that the cavity comprises part of an overall sealing arrangement for reducing the amount of microwave energy which escapes from within heating chamber during its heating operation.

Each of the door arrangements 48 also includes a second L-shaped door section (again actually its mirror image which, as will be seen, is connected for movement between a first position a sufficient distance from opening 50 to allow articles 16 to pass readily therethrough, and a second position for closing the opening to passage of these articles. This latter door section, which is generally designated at 64, also includes a vertically extending subsection 66 and a horizontal subsection 68. As illustrated best in FIG. 3, when door section 64 is in its second, closed position, the two door sections register together. More specifically, vertical subsection 66 includes an inwardly facing surface which is located in confronting relationship with the outwardly facing surface on vertical subsection 56 and, at the same time, this confronting surface on vertical subsection 66 extends entirely across openings 50 and 58 for closing passage therethrough. In a similar manner, horizontal subsection 68 includes a downwardly facing surface which is located in confronting relationship with an upwardly facing surface on the horizontal subsection 60. While the confronting surfaces on vertical subsections 56 and 66 preferably engage one another when movable door section 64 is in its closed position, the two horizontal subsections are spaced a predetermined distance from one another so as to define a gap 70, preferably of uniform depth, therebetween. This gap extends entirely across the two confronting surfaces and into openings 58 and 50 and it must be sufficiently wide to allow conveyer belt 18 to extend therethrough, as illustrated. If the conveyer belt is formed with an overlapping seam, the gap must take this into account. Moreover, in a preferred embodiment of the present invention, it is desirable to move the conveyer belt even when the movable door section is in its closed position. Accordingly, the depth of gap 70 must take this into account and hence be slightly greater than the thickness of the belt. As stated previously, the belt may be ten to fifteen mils thick and hence the gap should be at least this thick and preferably at least about five mils thicker so as to allow movement of the belt within the gap.

Door section 64 may be constructed in the same preferred way as previously described door section 54, that is, utilizing a single sheet of suitable material, for example, aluminum, and pressed or otherwise formed into its ultimate shape. In its preferred embodiment, movable subsection 54 also includes a groove or cavity, generally indicated at 72. This groove or cavity preferably extends continuously about the combined periphery of the two subsections 66 and 68 and their respective confronting surfaces. In fact, this groove or cavity may also be provided while door section 64 is still in its plainer state as described with respect to cavity 62. The precise reason for this cavity, which is preferably filled with a material to be described, and which is located in an offset position relative to channel 62, will be discussed hereinafter. For the moment, it should suffice to state that the cavity comprises part of the overall sealing arrangement referred to previously.

In addition to a fixed door section and a movable door section 64, each of the overall door arrangements 48 includes a mechanism generally designated at 74 for moving the movable door section between its opened position, as indicated by phantom lines, and its closed position, as indicated by solid lines. As illustrated in FIG. 3, this movement is in a straight line direction at an angle or incline with the horizontal. Moreover, vertical subsection 66 and horizontal subsection 68 remain vertical and horizontal, respectively, during this movement. This parallelogram type movement is preferred over vertical movement because the latter involves very tight dimensional control over the overall door arrangement, particularly along the joints. By moving the door section at an angle, dimensional control is not as critical. Moreover, the path of motion of the movable door section does not have to be as precise. Of course, the movable door section could be hinged at its top edge to the top edge of the fixed door section, but the parallelogram type movement is most preferred.

Figure 4:
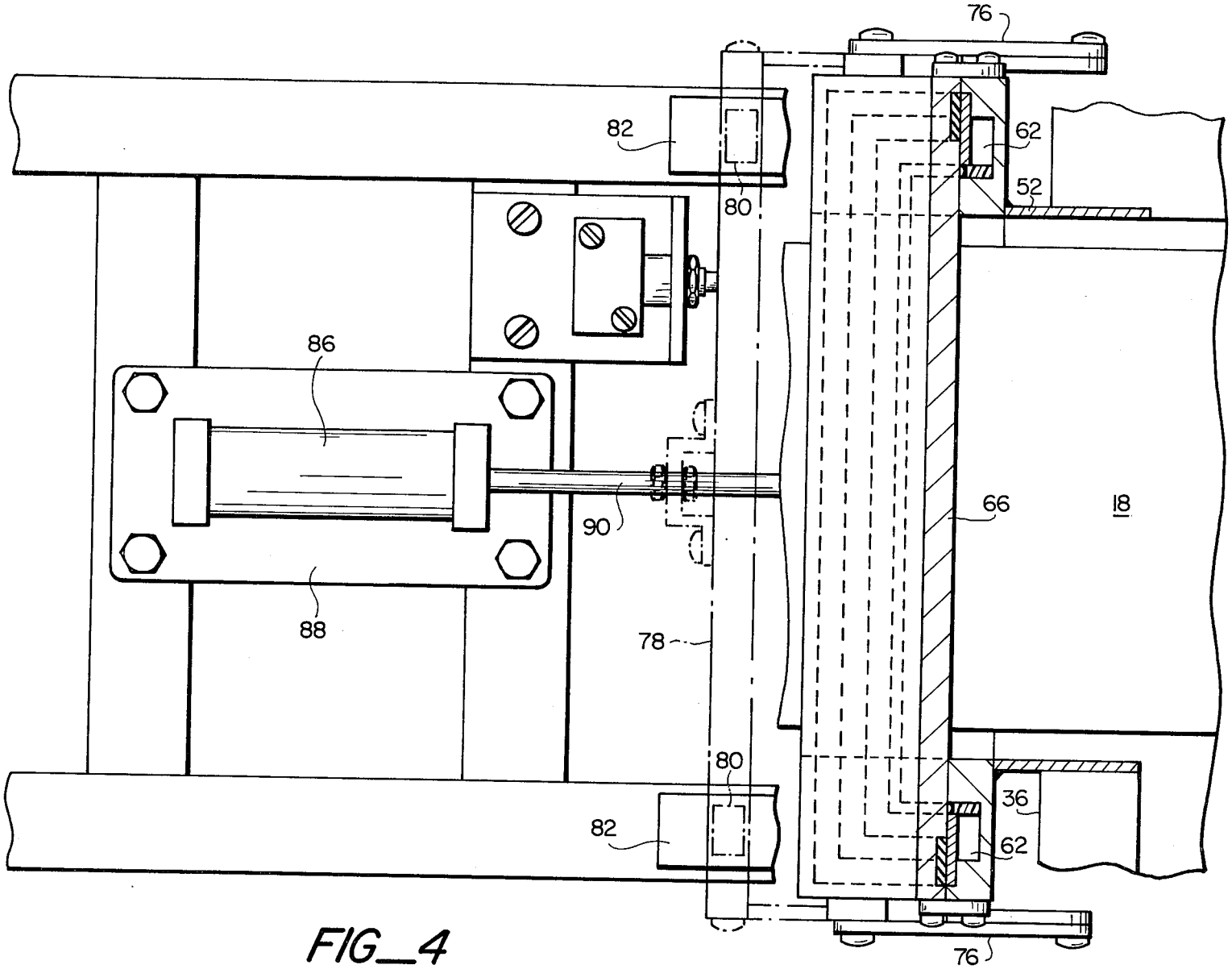
FIG. 4 is a sectional view of a part of the system illustrated in FIG. 1, taken generally along line 4—4 in FIG. 3.

In order to accomplish the movement just described, arrangement 74 includes a plurality of appropriately pivotally mounted support links 76 illustrated in both FIGS. 1 and 3 for supporting and actually guiding movable door section 64 along its parallelogram type movement between its open and closed position. Some of these links are interconnected between the movable door section and the fixed door section, as illustrated in FIG. 1, while others are interconnected between the movable door section and a drive rod 78. This drive rod, which is best illustrated in FIGS. 3 and 4, is located under its associated door arrangement and, in fact, under the horizontal section of conveyer belt 18 and extends normal to the movement of the conveyer belt. Moreover, the drive rod is mounted on at least one wheel 80 for movement along a fixed track 82 mounted to part of previously recited frame assembly 26 of arrangement 14. The track extends parallel to the horizontal section of conveyer belt 18 and supports drive rod 78 and its associated wheel for movement between a forwardmost position, as illustrated by solid lines, and a rearwardmost position, as illustrated by dotted lines. In its forwardmost position, the drive rod which, as stated previously, is interconnected to some of the interconnecting links 76, positions the movable door section in its closed position and causes it to move to its opened position as the drive rod moves to its rearwardmost position.

In order to move the drive rod between the two positions just described, arrangement 74 includes a conventional piston and cylinder assembly 84 which may be electrically, pneumatically or even hydraulically actuated. This piston and cylinder assembly includes a fixed cylinder 86 fixedly mounted to frame assembly 26 by bolted bracket 88 and a movable piston 90 having its otherwise free end bolted to drive rod 78, as illustrated in FIG. 3. It is to be understood, that the present invention is not limited to this particular piston and cylinder assembly. Any suitable means may be provided for moving drive rod 78. In fact, it is to be understood that the present invention is not limited to the particular arrangement including drive rod 78 for moving door section 64.

As will be seen hereinafter, the primary purpose for door arrangement 48 is to allow the conveyer belt to be positioned within the heating cavity of microwave oven 12 when the openings 50 are closed, that is, when the movable sections of the door arrangements are in their closed positions. However, because of these movable components, specifically the movable door sections, there are a number of places where the microwave energy can escape. However, each of these door arrangements includes a sealing mechanism for reducing the amount of energy which escapes from within the chamber, specifically along the periphery of its movable door section and also out its associated gap 70. There are a number of mechanisms for sealing off microwave energy, that is, for preventing the escape of the energy around the periphery of a door or the like, including for example, choke mechanisms, capacitive mechanisms, and absorptive mechanisms or a combination of these. However, in a preferred embodiment of the present invention, the choke mechanism is utilized because this mechanism permits a positive gap to exist, specifically previously described gap 70 between fixed door section 54 and movable door section 64. In this regard, along the surfaces of the two door sections which may be direct contact with each other, for example, along the confronting surfaces of the vertical subsections, a microwave seal in the form of metal to metal contact might work just as well. However, the utilization of a choke seal around the entire periphery of these two door sections is preferred.

The choke mechanism comprising part of the door arrangement 48 is generally designated at 92 and include previously described continuous cavity 62. The choke mechanism is a continuous one following the path of cavity 62 and in addition to this cavity includes a metal cover plate 94 which extends over the entire cavity with the exception of a very small inlet 96 extending completely around the inwardmost edge of the cavity along its entire length. While not absolutely necessary, the choke mechanism may include suitable means for preventing dirt and other such foreign particles from lodging within cavity 62. In a preferred embodiment, such means include a section of foamed plastic having essentially the same dielectric constant of air, specifically polystyrene foam having about a one hundred-to-one volumetric ratio. The dielectric constant of this material is so close to air that it can be neglected in the design of the choke. Located over this material and actually sealing off the inlet 96 against foreign particles (but of course not microwave energy) is an appropriate sealing material, for example, silicon rubber adhesive, which cures in place on top of the polystyrene foam and adheres very strongly to aluminum and provides a quite effective closure not only against solid particles but also against the penetration of moisture.

The general type of choke mechanism just described is well known in the art and in and by itself does not form a part of the present invention other than in combination with the door arrangements of oven 12. As a result, a detailed discussion of this mechanism including detailed dimensional requirements will not be provided. One with ordinary skill in the art can readily provide this type of microwave seal based on the dimensions of the door arrangement, the amount of energy generated within the oven assembly and the wavelength or wavelengths at which the oven assembly operates. It is sufficient to say that as the microwave energy flows from inside the oven through the various cracks between the movable door section and fixed door section making up each overall door arrangement, with gap 70, the choke mechanism operates to capture at least some of this energy so as to reduce the amount which escapes to a level below a predetermined standard.

As just stated, one with ordinary skill in the art could readily determine the required dimensions of choke mechanism 92 based upon the various other dimensions and parameters of the oven assembly generally and the door arrangements in particular. In fact, these dimensions would not only vary with these various parameters but also with the desired efficiency to be attained which may well depend upon economical considerations. In any case, there are certain preferable dimensions. For example, it has been found to be desirable to make the shortest distance between the edge of cavity 62 including inlet 96 and opening 58, as indicated by the dimension "d" to be approximately one quarter wave length of the operating wave length of oven assembly 12. In other words, if fixed door section 56 were to be viewed in its plainer, flat state, as described previously, the innermost edge of cavity 92 would extend around opening 58 at a distance one quarter wave length away. In an actual working embodiment of the present invention, microwave oven assembly 12 operates at 2,450 cycles which is the operating wave length frequency for a wave length of about 4.8 inches. Accordingly, the distance "d" is about 1.2 inches. In addition, in this embodiment, while the depth of cavity 62 is not critical, its preferred width is also about one quarter wave length. However, again, it is to be understood, that these specific dimensions are provided merely for examplary purposes and are not intended to limit the present invention as stated previously, the dimensional requirements of choke 92 may vary and, in any event, can be provided by those with ordinary skill in the art.

In addition to the choke mechanism, the overall sealing mechanism comprising part of each of the door arrangements may include previously described cavities 72 which, as stated and as particularly illustrated in FIG. 3, is slightly offset outwardly relative to inlet 96, when the movable door section is in its closed position. Disposed within cavity 72 is a material 98 which is provided as a backup for further reducing the escape of microwave energy. This material is of a type which at least to a limited degree absorbs microwave energy. In a peferred embodiment, it is neoprene rubber which is loaded with a special form of iron powder designed to be very absorptive of microwave energy. However, almost any kind of rubber or polymer can be utilized and there are many other types of filler other than iron powder such as, for example, ferrite powder. In any event, like with the choke mechanism, one with ordinary skill in the art can readily provide this type of absorptive sealing mechanism as well as the dimensional requirements to maximise its function.

Having described choke mechanism 92 and its backup absorptive mechanism comprising cavity 72 and associated material 98, it is necessary to briefly point out that the largest loss in microwave energy will most likely occur through the predesigned gaps 70. Accordingly, it is important to make these gaps as small as possible and yet allow them to function in the intended manner, specifically to allow entry of the conveyer belt and, in a preferred embodiment, to allow the conveyer belt to move while the doors are closed. In the actual embodiment illustrated, conveyer belt 18 is not as wide as the horizontal subsections of each door arrangement. Accordingly, in this embodiment, the underside of horizontal subsection 68 is grooved along its entire length, as indicated at 99 and is just slightly wider than the conveyer belt. In this way, the confronting surfaces of the horizontal subsections on both sides of the conveyer belt can make metal to metal contact with each other and thereby further reduce the escape of microwave energy.

The various mechanisms for making oven assembly 12 more energy efficient have been described and, as stated, may vary. Moreover, it is to be understood that if a choke mechanism is used and a backup absorptive system, as described, the choke mechanism could just as readily be located within the movable section of each door arrangement and the absorptive mechanism, if used, could be readily located in the fixed door section.

Having described the entire oven assembly, attention is now directed to the manner in which the overall system 10 may be operated. Turning to FIG. 1, it can be seen that an article, for example, a tray of sandwiches, is positioned on the conveyer belt. The network of controls associated with conveyance arrangement 14 and those associated with the oven assembly can be readily designed such that tray 16 automatically moves toward the left hand door arrangement 48 and as it reaches a certain point, the movable section of the door arrangement automatically moves to its open position for allowing the tray to enter cavity 78. At the same time, the movable door section on the other door arrangement would open allowing the tray from within to move outside the chamber. Thereafter, the doors would close and the oven assembly would be energised for heating the article therein for a predetermined period of time, at which time the cycle would repeat itself. Moreover, these controls could include means for automatically oscillating the conveyer back and forth in a predetermined way or in any event for moving the tray through the oven assembly at a predetermined speed so as to provide uniform heating.

It should be quite apparent that oven assembly 12, as described, most preferably includes a pair of door arrangements 48. However, the assembly could operate with only one such door. In this case, the door opening would be large enough so that the conveyer could come in and out of the same door making, in effect, a U-turn within the oven assembly, thereby requiring only one door. Moreover, it should be quite apparent that the oven could be operated in a manual mode using manual door 46.

What is claimed is:

1. A microwave oven assembly, comprising:

(a) a housing defining an internal chamber for heating articles therein and including at least one vertically extending opening for passage of said articles into and out of said chamber;

(b) means for producing microwave energy within said chamber for heating said objects therein;

(c) a first L-shaped door section fixedly connected with said housing and including (i) a vertical subsection positioned around said opening, and (ii) a horizontal subsection extending from the bottom edge of said vertical subsection away from said opening;

(d) a second L-shaped door section connected with said housing for movement between a first position a sufficient distance from said opening to allow said articles to pass readily therethrough and a second position for closing said opening to the passage of said articles, said movable door section including (i) a vertical subsection having a surface which is located in confronting relationship with a surface on the vertical subsection of said fixed door section and extending across said opening when said movable section is in its closed position, and (ii) a horizontal subsection having a surface which is located in confronting relationship with a surface on the horizontal subsection of said fixed door section when said movable section is in its closed position;

(e) said door sections together defining a gap extending between said horizontal subsections and into said opening when said movable door section is in its closed position, said gap being sufficiently large to allow an object carrying conveyance mechanism to extend into said chamber through said gap;

(f) means for moving said movable door section between its open and closed positions, and (g) seal means for reducing the amount of microwave energy escaping from within said heating chamber along the periphery of said movable door section and said gap to a level below a predetermined standard when said movable section is in its closed position.

2. An assembly according to claim 1 wherein said moving means moves said movable door section along a path which is inclined relative to the horizontal, said moving means including means for maintaining said vertical and horizontal subsections of said movable section in vertical and horizontal positions, respectively, during said movement.

3. An assembly according to claim 1 wherein said seal means includes a microwave choke arrangement which includes a continuous cavity extending around the combined outer periphery of the vertical and horizontal confronting surfaces on one of said door sections and inwardly therefrom.

4. An assembly according to claim 3 wherein said choke arrangement includes means for defining an inlet along the entire length of and into said cavity along the innermost edge thereof, said inlet being substantially narrower than the width of said cavity.

5. An assembly according to claim 4 wherein said choke arrangement includes means located within said groove for preventing dirt from lodging therein without significantly reducing the efficiency of said choke arrangement.

6. An assembly according to claim 4 wherein said energy producing means produces microwave energy at a predetermined wavelength and wherein the shortest distance between any point on said inlet along the entire length of said cavity in said vertical and horizontal confronting surfaces and the outer periphery of said housing opening is about one quarter of said wavelength.

7. An assembly according to claim 6 wherein the width of said cavity from said inlet at its innermost edge to its outermost edge is about one quarter of said wave length.

8. An assembly according to claim 4 wherein said seal means includes a second continuous cavity extending around the combined outer periphery of the vertical and horizontal confronting surfaces on the other of said door sections and inwardly therefrom, said second cavity being offset relative to said inlet and including means therein for further reducing the amount of microwave energy escaping from within said chamber.

9. A system for heating articles comprising:

(A) a microwave oven assembly including (a) a housing defining an internal chamber for heating articles therein and including first and second openings for passage of said articles into and out of said chamber, respectively, (b) means for producing microwave energy within said chamber for heating said objects therein, and (c) a door arrangement associated with each of said openings and connected with said housing, each of said door arrangements including (i) a predetermined section movable between a first position spaced a sufficient distance from its associated opening to allow said articles to pass readily therethrough and a second position which, with the exception of a gap sufficiently large to allow passage of a conveyance mechanism for carrying said objects into said chamber, closes said associated opening, (ii) means for moving said movable section between its opened and closed position, and (iii) seal means for reducing the amount of microwave energy escaping from within said heating chamber along the periphery of said movable section and said gap at a level below a predetermined standard when said section is in its closed position;

(B) conveyance means including a segment thereof which at all times extends into the chamber of said housing through the gap associated with the movable section of one of said door arrangements and back out of said chamber through the gap associated with the movable section of the other door arrangement, said conveyance means being movable along a continuous path for carrying objects into said chamber through one of said openings and out of said chamber through the other of said openings; and (C) means for moving said conveyance means along said continuous path.

10. A system according to claim 9 wherein said conveyance means is a continuous conveyor belt.

11. A system according to claim 9 wherein said gaps are sufficiently large to allow said conveyor belt to move even when the movable sections of said door arrangements are in their respective closed positions.

12. A system for heating articles, comprising:

(A) a microwave oven assembly, including (a) a housing defining an internal chamber for heating articles therein and including at least one vertically extending opening for passage of said articles into and out of said chamber, (b) means for producing microwave energy within said chamber for heating said objects therein, (c) a first L-shaped door section fixedly connected with said housing and including (i) a vertical subsection positioned around said opening; and (ii) a horizontal subsection extending from the bottom edge of said vertical subsection away from said opening;

(d) a second L-shaped door section connected with said housing for movement between a first position a sufficient distance from said opening to allow said articles to pass readily therethrough and a second position for closing said opening to the passage of said articles, said movable door section including (i) a vertical subsection having a surface which is located in confronting relationship with a surface on the vertical subsection of said fixed door section extending across said opening when said movable section is in its closed position; and (ii) a horizontal subsection having a surface which is located in confronting relationship with a surface on the horizontal subsection of said fixed door section when said movable section is in its closed position, (e) said door sections together defining a gap extending between said horizontal subsections and into said opening when said movable door section is in its closed position, said gap being sufficiently large to allow an object carrying conveyance mechanism to extend into said chamber through said gap, (f) means for moving said movable door section between its open and closed positions, and (g) seal means for reducing the amount of microwave energy escaping from within said heating chamber along the periphery of said movable door section and said gap when said movable section is in its closed position to a level below a predetermined standard;

(B) conveyance means including a segment thereof which at all times extends chamber of said housing through the gap associated with the movable section of one of said door arrangements and back out of said chamber through the gap associated with the movable section of the other door arrangement, said conveyance means being movable along a continuous path for carrying objects into said chamber through one of said openings and out of said chamber through the other of said openings; and (C) means for moving said conveyance means along said continuous path.

13. A system according to claim 12 wherein said conveyance means is a continuous conveyor belt.

14. A system according to claim 13 wherein said gaps are sufficiently large to allow said conveyor belt to move even when the movable sections of said door arrangements are in their respective closed positions.

15. A microwave oven assembly, comprising:

(a) a housing defining an internal chamber for heating articles therein including at least one opening for passage of said articles into and out of said chamber;

(b) means for producing microwave energy within said chamber for heating said objects therein; and (c) a door arrangement associated with said openings and connected with said housing, said door arrangement including (i) a predetermined section movable between a first position spaced a sufficient distance from said opening to allow said articles to pass readily therethrough and a second position which, with the exception of a subopening sufficiently large to allow passage of a conveyance mechanism for carrying said objects into said chamber, closes said opening;

(ii) means for moving said movable section between its opened and closed position, and (iii) seal means for reducing the amount of microwave energy escapting from within said heating chamber along the periphery of said movable section and through said sub-opening to a level below a predetermined standard when said section is in its closed position.

16. An assembly according to claim 15 wherein the movable section of each of said door arrangements includes a first vertically extending subsection which is positioned in confronting relation with its associated opening when the movable section is in its closed position and a second subsection extending horizontally from the bottom edge of said first subsection, away from said opening.

17. An assembly according to claim 16 wherein said moving means moves its associated movable section along a path which inclined relative to the horizontal.

18. An assembly according to claim 16 wherein said moving means includes means for maintaining said first and second subsections of said moveable means vertical and horizontal, respectively, during said movement.

19. An assembly according to claim 16 wherein said sub-opening is located along the bottom edge of said vertical subsection when said movable section is closed.

20. An assembly according to claim 15 wherein each of said door arrangements includes a second non-movable section fixedly connected with said housing and including its own opening in alignment with the associated opening into said chamber, said non-movable section and said movable section having outer peripheral surfaces which extend around said associated opening in confronting relationship with one another when said movable section is in its closed position.

21. A method of heating objects by means of microwave energy in an assembly line fashion, said method comprising:

(a) providing a microwave oven having an internal heating chamber, two passageways into said chamber, a door associated with each of said passageways and movable between a first position for opening its passageway and a second position for closing the passageway, and a gap extending along one edge of each of said doors for access into said chamber when said door is closed;

(b) continuously positioning a section of a conveyer belt into said oven chamber through one of said gaps and out of said chamber through the other gap;

(c) positioning an object on said conveyer belt outside of said oven;

(d) opening the door of said oven associated with said one gap;

(e) moving said conveyer belt so as to move said object into said chamber;

(f) closing said opened door;

(g) heating said object by means of microwave energy; and (h) after said object is heated, opening the door associated with said other gap for removing said heated object from said chamber.

22. A method according to claim 21 including stopping said conveyor belt once said object is within said chamber and starting it back up after said object is heated.

23. A method according to claim 21 including the step of moving said conveyor belt when said object is within said chamber and both of said doors are closed.

* * * * *